United States Patent [19]

Singh

[11] 4,283,251

[45] Aug. 11, 1981

[54] OZONE EFFLUENT BLEACHING

[75] Inventor: Rudra P. Singh, Brookhaven, Pa.

[73] Assignee: Scott Paper Company, Philadelphia, Pa.

[21] Appl. No.: 115,065

[22] Filed: Jan. 24, 1980

[51] Int. Cl.[3] ..... D21C 3/26

[52] U.S. Cl. ..... 162/17; 162/41; 162/60; 162/65; 162/78; 162/89

[58] Field of Search ..... 162/17, 41, 65, 78, 162/88, 89, 60

[56] References Cited

U.S. PATENT DOCUMENTS

| | | | |
|---|---|---|---|
| 2,466,633 | 4/1949 | Brabender et al. | 162/65 |
| 3,451,888 | 6/1969 | Ancelle et al. | 162/65 |
| 4,158,597 | 6/1979 | Petterson | 162/238 |

FOREIGN PATENT DOCUMENTS 966604 4/1975 Canada .

*Primary Examiner*—Peter Chin

*Attorney, Agent, or Firm*—John A. Weygandt; N. J. DeBenedictis

[57] ABSTRACT

The bleaching of fluff cellulosic pulp with a gaseous ozone bleaching agent at an acidic pH is often followed by an alkaline treatment, usually an alkaline extraction or an alkaline hydrogen peroxide bleaching treatment, at a much higher water content than the gaseous ozone treatment of the fluff pulp. Such a bleaching sequence of gaseous ozone bleaching followed by an alkaline treatment is improved by the present invention based upon two discoveries, first, the discovery of peroxygen bleaching values in the water associated with the fluff pulp leaving the ozone bleaching treatment, and second, the peroxygen values are destroyed at the alkaline pH used for the alkaline treatment that follows the gaseous ozone bleaching treatment. In accordance with the discoveries, a Low Consistency Acidic Retention Treatment is interposed between the gaseous ozone bleaching treatment and the alkaline treatment. The retention treatment comprises retaining the ozone bleached pulp in contact with the water associated with the fluff pulp during gaseous ozone bleaching along with additional water and at an acidic pH for at least ten minutes during which time the peroxygen values contained in the water react with the pulp to bleach the pulp. Thereafter, sufficient alkali is added to raise the pH above 7 in preparation for the subsequent alkaline treatment.

10 Claims, 2 Drawing Figures

OZONE EFFLUENT BLEACHING

TECHNICAL FIELD

The present invention relates to ozone and peroxygen bleaching of cellulosic pulp.

BACKGROUND ART

Prior ozone bleaching processes have been performed at either a low pulp consistency or a high consistency. Pulp consistency refers to the water content of the pulp. High consistency pulp is a solid-like, fluff pulp at a consistency of 20% to 45% while low consistency generally refers to a pumpable mixture of about 1% to 5% pulp by weight on an air dried basis.

A low consistency ozone bleaching process uses large volumes of water in contact with the pulp (the pulp constitutes about 1% to 5% by weight of the total) and ozone is diffused or dissolved into the water so that ozone bleaching of the pulp occurs in the water phase.

High consistency ozone bleaching is a gaseous ozone bleaching treatment in which fluff pulp, an apparently solid fibrous material, is contacted with gaseous ozone in a suitable vessel such as the vessel disclosed in U.S. Pat. No. 4,158,597, at an acid pH for sufficient time to bleach the pulp. An ozone bleaching process is disclosed in U.S. Pat. No. 3,451,888 entitled Bleaching Pulp Having High Consistency With Ozone Having Moisture Content Near 100%, and in Canadian Pat. No. 966,604 entitled Kraft Pulp Bleaching and Recovery Process. As disclosed in said Canadian Patent, the high consistency pulp from the gaseous ozone bleaching treatment may be washed if desired and then is treated with alkali in an alkaline extraction treatment or with an alkaline solution of hydrogen peroxide (see page 3, line 22 to page 4, line 11) after ozone bleaching. Washing of the pulp has been suggested prior to alkali treatment but washing displaces the water associated with the pulp during gaseous ozone bleaching while treating with alkali to a pH above 7 destroys the peroxygen values discovered by applicant in such water.

Recycle of effluent from various bleaching treatments to reduce the fresh water requirements of the bleaching operations is well known as disclosed in said Canadian Patent (page 4, lines 17 to 30). However, effluent is not obtained from the gaseous ozone bleaching treatment because the pulp is at a very high consistency (20% to 45%) and appears like a solid fluff. After ozone bleaching, water is added to the ozone bleached fluff pulp in substantial quantities to reduce the consistency to about 1% to 5% in order to achieve a pumpable water/pulp mixture an alkali is immediately added in preparation for the alkaline treatment that immediately follows the gaseous ozone bleaching treatment. This addition of alkali to the pumpable water/pulp mixture destroys the peroxygen values discovered therein by applicant.

DISCLOSURE OF INVENTION

Based upon the discovery of peroxygen values in the acid water associated with the fluff pulp exiting from the gaseous ozone bleaching reaction at a pH less than 7 and the discovery that the peroxygen values are destroyed at an alkaline pH, a process has been devised that utilizes these peroxygen values to achieve some peroxygen bleaching of the pulp without the need to add peroxygen bleaching chemicals. The improved process sequence comprises: a gaseous ozone bleaching step; a Low Consistency Acidic Retention Treatment; and an alkaline treatment of the pulp from the Low Consistency Acid Retention Treatment.

BEST MODE FOR CARRYING OUT THE INVENTION

The gaseous ozone bleaching treatment is conventional and preferably performed at a high consistency (20% to 45% pulp by weight and the balance water) and at an acid pH (less than 7) and bleached with a gaseous mixture containing oxygen and about 2% to about 4% ozone. Canadian Pat. No. 966,604 discloses such an ozone bleaching process. Residence time for the fluff pulp in the ozone reactor is preferrably about 30 seconds at a temperature of about 25° to 30° C. The gas exiting from the ozone reactor is essentially depleted of ozone (e.g. less than 1% ozone). Previously, such ozone bleached fluff pulp was washed and treated with alkali as described in example 1 of Canadian Pat. No. 966,604. The bleaching sequence of the present invention deviates from such previous bleaching sequences by interposing a Low Consistency Acidic Retention Treatment prior to washing or treating the ozone bleached fluff pulp with alkali.

Figure 1:
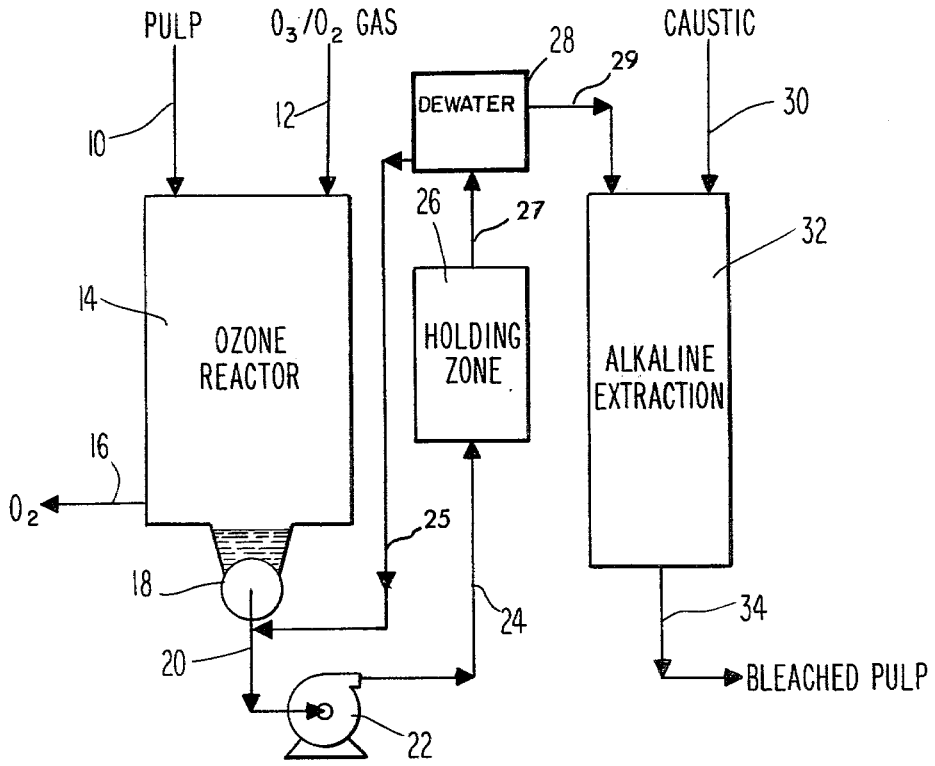
FIG. 1 depicts the Low Consistency Acidic Retention Treatment interposed between a gaseous ozone bleaching treatment and an alkaline extraction treatment. Also shown is recycle of the effluent after the Low Consistency Acidic Retention Treatment.

The bleaching process of the present invention can be best understood with reference to FIG. 1. In the drawing, fluff pulp 10 at a consistency of 20% to 45% and at an acidic pH is added to an ozone reactor along with a gaseous mixture 12 containing ozone, usually about 2% to 4% ozone with the balance oxygen or air. The ozone in the gaseous mixture is essentially depleted in the ozone reactor during the bleaching reaction with the pulp and gas 16 exits the ozone reactor generally free of ozone. The ozone bleached pulp 20, still at a high consistency (20% to 40%) is discharged from reactor 14 through a discharge device 18 having a gas trap such as a plug or pulp and water above the discharge device to impede the escape of ozone or oxygen gases from the reactor along with the pulp. After ozone bleaching the consistency of pulp 20 is reduced by the addition of water usually to a consistency of 12% or less, preferably to between 1% and 6%. A pumpable consistency of about 1% to 3% is quite suitable for the pulp. This lower consistency pulp 24 is transferred while still at an acidic pH to a holding zone 26. The pH of the ozone bleached pulp 20 and 24 is acidic due to the conditions inside the ozone reactor and therefore the pH of the pulp in holding zone 26 is also acidic. It is critical that the pH of this ozone bleached pulp not be raised to 7 or above until after the retention time in holding zone 26. The retention time of the pulp in holding zone 26 is from about 10 minutes to about 60 minutes with about 12 minutes being preferred. Accordingly, this portion of the process in which pulp is maintained at an acidic pH and in contact with the water associated with the ozone bleached fluff pulp when it was in the ozone reactor and with some additional water to lower the consistency of the pulp, is referred to herein as a Low Consistency Acidic Retention Treatment. The low consistency pulp 27 existing from holding zone 26 has been subjected to the Low Consistency Acidic Retention Treatment and has been bleached to a greater degree than pulp 24 due to bleaching by peroxygen values available in the water associated with the fluff pulp 20 from the ozone reactor. The low consistency ozone and peroxygen bleached pulp 27 is preferably dewatered 28 to produce pulp 29 before being subjected to a conventional alkaline pH treatment such as an alkaline extraction treatment, an alkaline peroxide or peroxygen bleaching treatment, or an alkaline hypochlorite bleaching treatment. FIG. 1 shows pulp 29 entering an alkaline extraction stage in which caustic is added to raise the pH of the pulp to above 7 (preferably 10 to 11). Dewatered pulp 29 is preferably at a consistency of about 10% to 20%, more preferably about 12% although the dewatering step can be omitted. Water 25, obtained from dewatering pulp 27, is at an acidic pH and is preferably recycled to supply the water needed to lower the consistency of ozone bleached fluffed pulp 20 from the ozone reactor because the lowering of the consistency must be achieved without raising the pH of the ozone bleached fluff pulp to 7 or above.

Retention time for the pulp in holding zone 26 is preferably optimized. If the retention time in holding zone 26 was reduced to 0 then peroxygen bleaching would not occur and peroxygen values would build up in recycle stream 25 to a significant level of about 0.17 grams per liter peroxides reported as hydrogen peroxide. By increasing the retention time of the pulp in holding zone 26, more of the peroxygen values in the water associated with pulp 20 will be consumed for bleaching of the pulp in holding zone 26 which reduces the peroxide values in recycle 25. Monitoring of peroxide values in recycle 25 provides the information needed to maximize bleaching of the pulp in holding zone 26. The exact nature of the peroxygen values is not understood except that they exhibit a bleaching effect upon cellulosic pulp with time at an acidic pH and give a positive result when tested for peroxygen values by titration according to the TAPPI test for hydrogen peroxide.

The following examples illustrate specific embodiments of the process in greater detail. The best mode presently contemplated for practicing the invention is continuously with recycle of effluent as shown in FIG. 1 and disclosed in Example 3 in accordance with the process conditions discussed above and exemplified hereinafter. In all of the examples the brightness levels reported are Elrepho brightness units, consistency refers to the percent by weight pulp (air dried basis) in the pulp/water mixture and all proportions are by weight unless indicated otherwise.

EXAMPLE 1

A 200 gram sample of southern hardwood kraft pulp (oven dried basis) was treated with water and sulfuric acid to yield a 35% consistency pulp at a pH of 1.9. This acidified 35% consistency pulp was contacted with oxygen containing 3% ozone and at a temperature of 25° C. for about 1 minute during which time the pulp was continuously agitated to insure good contact between the pulp stream and the cocurrent gaseous ozone stream. The amount of ozone consumed by the pulp during the bleaching process was about 1% ozone based upon the oven dried weight of the pulp.

The ozone bleached pulp had a brightness of 69.1 after being discharged from the ozone reactor. The ozone bleached pulp was then diluted with water from the consistency of 35% to a consistency of 4%. After mixing, a sample of the water in the 4% consistency pulp mixture was analyzed for peroxygen values according to the TAPPI titration test for hydrogen peroxide and the water contained 0.034 grams per liter peroxygen values reported as hydrogen peroxide. The pH of the 4% consistency pulp was 2.7. The 4% consistency pulp was retained at ambient temperature without the addition of alkali for 60 minutes and at 10 minute intervals the pulp was tested for brightness and the water was tested for peroxygen values. The results of the tests are listed in Table 1.

EXAMPLE 2

The procedure of example 1 was repeated with the additional step of subjecting each pulp sample taken at 10 minute intervals to an alkali extraction treatment using a 2% sodium hydroxide solution and at a consistency of 12% for the alkaline extraction step. The brightness of the alkaline extracted pulp and the peroxygen values in the water associated with the pulp sample prior to being treated with alkali are reported in Table 2.

EXAMPLE 3

Figure 2:
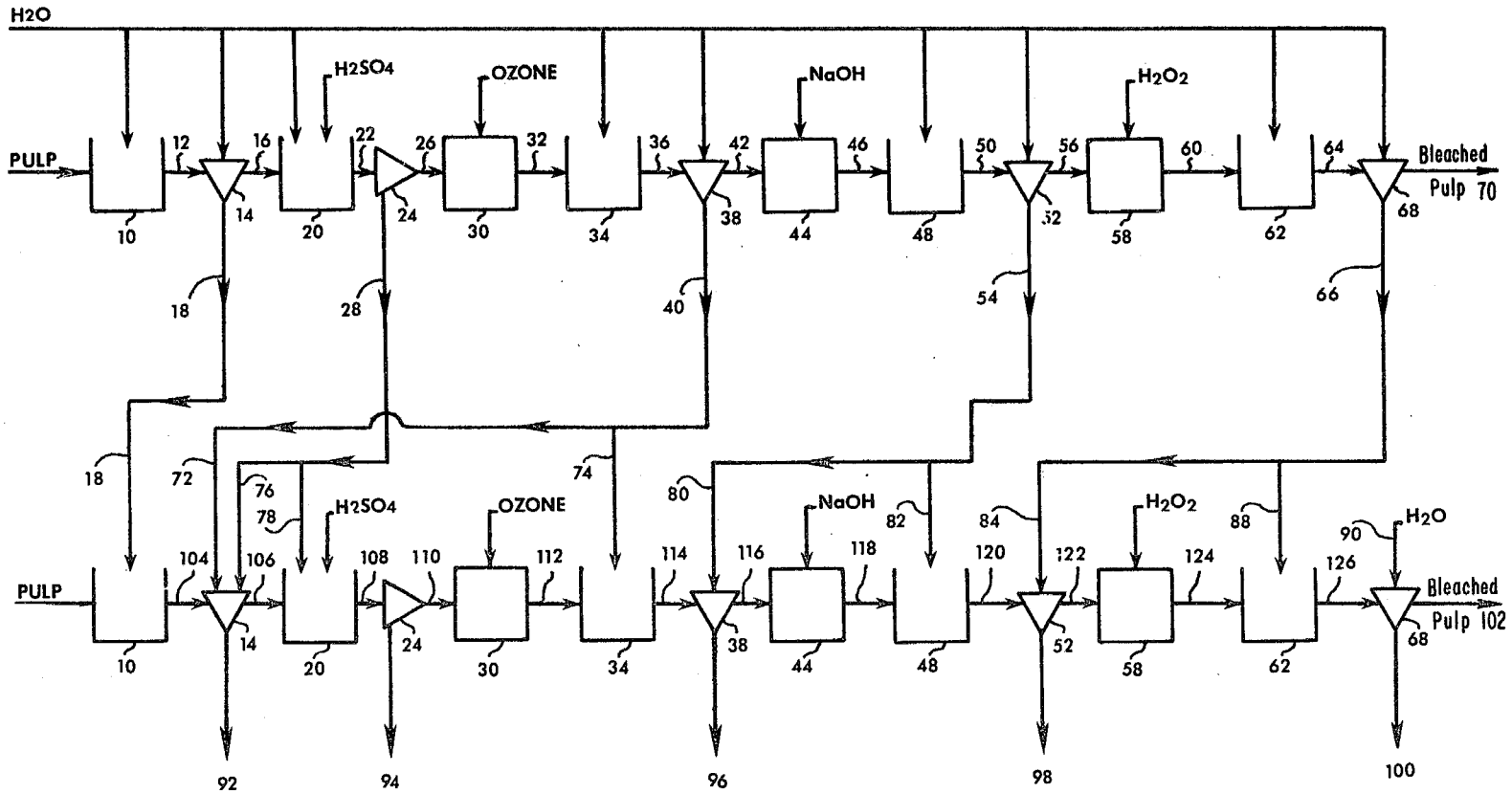
FIG. 2 shows a batch bleaching process with effluent recycle.

FIG. 2 is the process flow chart for this example. A sequence of batch treatments were employed in order to approximate in the lab a continuous bleaching process employing bleaching with gaseous ozone; a Low Consistency Acidic Retention Treatment; pulp washing; alkaline extraction; pulp washing; alkaline peroxide bleaching and final pulp washing. Countercurrent recycle of effluent from each of the pulp washing steps was practiced as shown in FIG. 2. Initially, a first pulp sample of 500 grams of oven dried kraft southern hardwood pulp was diluted with water in tank 10 to a consistency of 4% to produce pulp 12. Pulp 12 was then washed by adding 4,500 grams of water and pressing in 14 to extract 13,000 grams of liquid extract 18 and pulp 16 having a consistency of 12.5%. Pulp 16 was then acidified and its consistency raised to 35% in preparation for ozone bleaching. This was accomplished by adding 8,500 grams of water, sulfuric acid and pulp 16 to tank 20, mixing and then extracting 11,100 grams of extract 28 in press 24 to produce the acidified, 35% consistency pulp 26 at a pH of 1.9. Pulp 26 was then bleached in ozonator 30 at a temperature of 25° C. and with an oxygen gas containing 2.9% ozone for a sufficient reaction time to consume essentially all of the ozone in the gaseous mixture. The pulp and the ozone containing gas flowed cocurrently through the ozonator 30. The amount of ozone consumed equalled 1% based upon the dry weight of the pulp. A 100 gram sample of the ozone bleached pulp was removed and the remaining 400 grams of ozone bleached pulp 32 was diluted with 8,900 grams of water in tank 34 (consistency 4%). Pulp 36 was washed with an additional 4,000 grams of water and pressed in 38 to produce 10,800 grams of extract 40 and pulp 42 at a consistency of 12%. Sodium hydroxide was added to pulp 42 in tank 44 for caustic extraction. Caustic pulp 46 was placed in tank 48 where an additional 6,800 grams of water was added followed by washing of pulp 50 with an additional 4,000 grams of water and pressing (extracting) in press 52 to produce 10,800 grams of extract 54 from the alkaline extraction and washing treatment and to produce extracted pulp 56 at a consistency of 12%. Pulp 56 was treated with hydrogen peroxide, sodium hydroxide and sodium silicate in reactor 58 in order to subject the pulp to a conventional alkaline peroxide bleaching treatment. The alkaline peroxide bleached pulp 60 was diluted with 6,800 grams of water in tank 62 and the resulting pulp 64 was washed with 4,000 grams of water and pressed in press 68 to produce 400 grams of bleached pulp product 70 and 10,800 grams of extract 66. A second, 500 gram sample of southern hardwood kraft pulp was then subjected to the same sequence of bleaching and washing treatments in the same equipment as shown by the lower portion of the process diagram in FIG. 2. Extracts from the bleaching and washing treatments of the first pulp sample were collected and used in the treatment of the second pulp sample in order to reproduce the effect of countercurrent recycle of extract. The second, 500 gram pulp sample was combined with 12,500 grams of water extract 18 from the treatments of the first pulp sample to yield pulp 104 at a consistency of 4%. 4,500 grams of water (72 and 76) used to wash pulp 104 was obtained by combining 1,900 grams of extract 40 and 2,600 grams of extract 28. The washing and pressing of pulp 104 yielded 13,000 grams of extract 92. The remaining 8,500 grams of extract 28 was used along with sufficient sulfuric acid to acidify the washed pulp 106 to a pH of 1.9 prior to ozonation. 11,100 grams of extract 94 was then obtained from the pressing of acidified pulp 108 to a consistency of 35% and a pH of 1.9 (pulp 110). 8,900 grams of water 74 used to lower the consistency of ozone bleached pulp 112 was obtained from extract 40 from the previous bleaching sequence. An additional 4,000 grams of water 80 used to wash ozone bleached pulp 114 was obtained from extract 54. After the alkali extraction of washed pulp 116, the extracted pulp 118 was diluted with 6,800 grams of water 82 obtained from extract 54. Diluted pulp 120 was then washed by the addition of another 4,000 grams of water 84 obtained from extract 66 and then pressed. This resulted in 10,800 grams of water extract 98 and extracted pulp 122 at a consistency of 12%. Pulp 122 was then bleached with hydrogen peroxide at an alkaline pH and in the presence of sodium silicate in a conventional manner. 6,800 grams of water 88 obtained from extract 55 was used to adjust the consistency of $H_2O_2$ bleached pulp 124 prior to washing and pressing. 4,000 grams of fresh water 90 was added to pulp 126 for washing. Pressing of pulp 126 yielded pulp product 102 and 10,800 grams of extract 100. This procedure was then repeated six more times (samples 3 through 8) each time employing a fresh 500 gram sample of pulp and using the extracts 92, 94, 96, 98 and 100 from the bleaching treatments of the previous pulp sample in the same manner as extracts 18, 28, 40, 54 and 66 from the bleaching treatments of the first pulp sample were used in the bleaching treatments of the second pulp sample as shown in FIG. 2.

The sequence of bleaching treatments and reuse of the extract in Example 3 approximately reproduces a continuous sequence of bleaching treatments employing ozone bleaching, alkaline extraction and alkaline hydrogen peroxide bleaching with countercurrent recycle of the effluents from the bleaching and extraction treatments (the washing and pressing of pulp following the addition of the appropriate chemicals is considered part of each treatment). Each batch of ozone bleached pulp (32 for the first sample and pulp 112 for samples 2 through 8) was kept in tank 34 at ambient temperature and at an acid pH for about 12 minutes while in contact with additional water for pulp 32 and with portion 74 of extract 40 for the second sample and portion 74 of extract 96 for samples 3 through 8. Extract portion 74 contains the water associated with the previous ozone bleached pulp sample. This resulted in peroxygen bleaching of the pulp in tank 34 in accordance with the present invention.

The dilution of each batch of ozone bleached kraft hardwood pulp 112 from samples 2 through 8 with extract 74 from the washing step of a previous ozone bleaching treatment and at an acid pH (if necessary sufficient sulfuric acid was added to adjust the pH to 1.9) and retention of the pulp in the acidified liquid for at least ten minutes resulted in the Low Consistency Acidic Retention Treatment as defined by the present invention. However, the peroxygen bleaching effect on samples 2 through 8 was greater than the effect obtained from the Low Consistency Acidic Retention step on pulp 32 because of the buildup of peroxygen values in extract 74 due to the countercurrent recycle of extract effluent.

Although the reuse of effluent 54 from sample 1 and effluent 98 from samples 2 through 7 as part of the wash water used in washing the ozone bleached pulp cause some addition of caustic to the ozone bleached pulp in tank 34, the amount of caustic was not enough to raise the pH to seven. Some caustic addition to the Low Consistency Acidic Retention Treatment is tolerable as long as the pH of the extract 74 or the low consistency pulp 112 to 114 does not reach 7. Preferably, sufficient acid is added to the Low Consistency Acidic Retention Treatment to maintain the pH between about 1.8 and 3.0.

Samples of pulp after being subjected to the ozone bleaching, Low Consistency Acidic Retention, and alkaline extraction steps (pulp 56 for sample 1 and pulp 122 for samples 2 through 8) were tested for brightness and reverted brightness. The results of the tests are reported in Table 3 in the columns under the heading $O_3$/E. Samples of the pulp after being subjected to ozone, Low Consistency Acidic Retention, alkaline extraction, and alkaline peroxide bleaching treatments (pulp 64 for sample 1 and pulp 126 for samples 2 through 8) were tested for brightness, reverted brightness and viscosity. The results of the tests are in Table 3 under the heading $O_3$/E/P. In addition, the pH of the various extracts were tested (18, 28, 40, 54 and 66 for pulp sample 1 and 92, 94, 96, 98 and 100 for pulp samples 2 through 8). Results of the pH tests appear in Table 3 under the heading Extracts.

In Example 3 seven fresh batches of pulp, labeled Pulp Samples 2 through 8 in Table 3 were treated with extracts from the previous batch of pulp in accordance with the sequence discussed above. The ozone bleaching was at ambient temperature with 2.9% ozone in the entering oxygen gas stream. The alkaline extraction was at 52° C. (125° F.) and with a retention time of 90 minutes prior to dilution and washing. The alkaline hydrogen peroxide bleaching treatment was at 71° C. (160° F.) and a retention time of 180 minutes prior to dilution and washing. The Low Consistency Acidic Retention Treatment was at ambient temperature although elevated temperatures can be employed, e.g. 25° C. to 100° C.

The Low Consistency Acidic Retention Treatment can be used as part of a bleaching sequence in combination with other conventional bleaching treatments including alkaline treatments as previously described and conventional acid pH treatments such as chlorine dioxide bleaching provided the alkali treatments are not between the gaseous ozone treatment and the Low Consistency Acidic Retention Treatment. In addition, bleaching agents suitable for use at an acid pH can be added to the Low Consistency Acidic Retention Treatment if desired, such as chlorine dioxide. An example of a bleaching sequence of this invention in combination with conventional treatments is gaseous ozone; Low Consistency Acidic Retention Treatment; chlorine dioxide bleaching and thereafter conventional alkaline treatments.

TABLE I

| Time | Brightness | Peroxygen (%) |
|---|---|---|
| 0 | 60.0 | 0.17 |
| 10 min. | 60.9 | 0.17 |
| 20 min. | 61.0 | 0.12 |
| 30 min. | 60.6 | 0.05 |
| 40 min. | 60.4 | 0.03 |
| 50 min. | 59.9 | 0.02 |
| 60 min. | 60.0 | 0.01 |

TABLE II

| Time | Brightness | Peroxygen (gm/l) |
|---|---|---|
| 0 | 69.1 | 0.034 |
| 10 min. | 71.2 | 0.020 |
| 20 min. | 71.7 | 0.014 |
| 30 min. | 71.8 | 0.012 |
| 40 min. | 71.8 | 0.009 |
| 50 min. | 71.6 | 0.007 |
| 60 min. | 71.2 | 0.003 |

TABLE III

| Pulp | Extract | | | | | $O_3$/E | | $O_3$/E/P | | |
|---|---|---|---|---|---|---|---|---|---|---|
| | 18 | 28 | 40 | 54 | 66 | | | | | |
| Sample | (92) | (94) | (96) | (98) | (100) | Bright | Rev. | Bright. | Rev. | Viscos. |
| 1 | 7.7 | 1.9 | 2.7 | 11.5 | 10.9 | 68.3 | 67.2 | 85.0 | 82.3 | 8.8 |
| 2 | 6.7 | 1.9 | 2.6 | 11.8 | 10.8 | 73.2 | 68.4 | 86.8 | 84.9 | 7.3 |
| 3 | 6.3 | 1.8 | 2.7 | 11.6 | 10.5 | 74.1 | 70.2 | 86.2 | 84.1 | 7.0 |
| 4 | 6.8 | 1.8 | 2.5 | 11.5 | 11.0 | 75.3 | 73.9 | 87.1 | 83.5 | 7.1 |
| 5 | 4.1 | 1.8 | 2.7 | 11.9 | 11.1 | 75.3 | 72.5 | 88.0 | 84.6 | 7.1 |
| 6 | 5.9 | 1.8 | 2.7 | 12.0 | 10.9 | 78.4 | 75.7 | 87.2 | 83.3 | 7.3 |
| 7 | 5.5 | 1.8 | 3.1 | 11.8 | 11.2 | 73.0 | 70.6 | 87.2 | 83.7 | 7.1 |
| 8 | 6.4 | 1.8 | 3.4 | 11.9 | 11.4 | 72.5 | 69.7 | 87.4 | 83.6 | 8.2 |

I claim:

1. In a pulp bleaching process employing a sequence of pulp treatments including a gaseous ozone bleaching treatment at a pulp consistency of from about 20% to about 45% and at an acidic pH followed by an alkaline treatment at a pH above 7 and at a pulp consistency lower than the pulp consistency in the ozone bleaching treatment; wherein the improvement comprises, employing a low consistency acidic retention treatment between the ozone bleaching treatment and the alkaline treatment, said low consistency acidic retention treatment comprising lowering the consistency of the pulp obtained from the ozone bleaching treatment by the addition of water to the pulp to a consistency of 12% or less by weight while maintaining the pulp at an acidic pH, retaining said ozone bleached pulp at said lower consistency and at said acidic pH for a retention time of at least ten minutes, whereby bleaching of the pulp is achieved during the retention treatment by peroxygen values available in the water associated with the pulp from the ozone bleaching treatment.

2. The process of claim 1 performed continuously and with countercurrent recycle of water obtained by dewatering pulp; comprising removing water from the pulp after said retention time, taking said removed water and combining said water with ozone bleached pulp entering the low consistency acid retention treatment to lower the consistency of the ozone bleached pulp whereby the use of peroxygen and acid values contained in the recycled water is maximized for bleaching pulp in the low consistency acid retention treatment.

3. The process of claim 1 wherein said retention time is from 10 minutes to 60 minutes and further comprising dewatering the pulp after said retention time to a consistency of 10% or higher.

4. The process of claim 3 further comprising using water obtained from said dewatering of the pulp as the source of water for lowering the consistency of the pulp obtained from the ozone bleaching treatment.

5. The process of claim 3 wherein the treating of the pulp with alkali is part of an alkaline extraction treatment of the pulp.

6. The process of claim 5 further comprising subjecting said alkali extracted pulp to an alkaline peroxide or alkaline peroxygen bleaching process.

7. The process of claim 1 wherein the consistency of the pulp in said low consistency acid retention treatment is about 4%.

8. The process of claim 1 wherein the consistency of the pulp in said gaseous ozone bleaching treatment is about 35%.

9. The process of claim 4 wherein said treating the pulp with alkali is part of a treatment selected from the group comprising alkaline extraction, alkaline peroxide bleaching, alkaline peroxygen bleaching and alkaline hypochlorite bleaching.

10. The process of claim 9 further comprising an acid pH bleaching treatment of the pulp after said Low Consistency Acidic Retention Treatment and prior to said treating the pulp with alkali to raise the pH to above 7.

* * * * *